US005540274A

United States Patent [19]

Slocum et al.

[11] Patent Number: 5,540,274

[45] Date of Patent: Jul. 30, 1996

[54] ROTARY REGENERATIVE HEAT EXCHANGER

[75] Inventors: Francis B. Slocum; Tadek C. Brzytwa; James D. Seebald, all of Wellsville, N.Y.

[73] Assignee: ABB Air Preheater, Inc., Wellsville, N.Y.

[21] Appl. No.: 349,781

[22] Filed: Dec. 6, 1994

[51] Int. Cl.[6] ..... F23L 15/02

[52] U.S. Cl. ..... 165/9

[58] Field of Search ..... 165/9

[56] References Cited

U.S. PATENT DOCUMENTS

| | | | |
|---|---|---|---|
| 3,216,486 | 11/1965 | Hall et al. | 165/9 |
| 3,710,850 | 1/1973 | Kurschner et al. | 165/9 |
| 3,818,978 | 6/1974 | Finnemore | 165/9 |
| 4,791,980 | 12/1988 | Hagar et al. | 165/9 |
| 5,048,595 | 9/1991 | Harder | 165/9 |

FOREIGN PATENT DOCUMENTS

| | | | |
|---|---|---|---|
| 2734966 | 2/1979 | Germany | 165/9 |
| 500682 | 2/1939 | United Kingdom | 165/9 |

*Primary Examiner*—John Rivell
*Assistant Examiner*—Christopher Atkinson
*Attorney, Agent, or Firm*—Chilton , Alix & Van Kirk

[57] ABSTRACT

A rotary regenerative air preheater has bypass seals located at the top and bottom of one side of each sector of heat exchange baskets located at the top and bottom of the adjacent diaphragm and sealing the gap between that one side of the baskets and the diaphragm. The bypass seals are metal strips extending along the radial length of the diaphragm with a main body portion attached to the diaphragm and a bent leg portion extending outwardly to engage the baskets. The bypass seals are notched to fit over the stay plates and are attached over the radial seals to hold the radial seals in position.

1 Claim, 4 Drawing Sheets

ROTARY REGENERATIVE HEAT EXCHANGER

BACKGROUND OF THE INVENTION

The present invention relates generally to rotary heat exchangers and, more specifically, to bypass seals for sealing the gaps around the exchange baskets.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality of sector-shaped compartments by a plurality of radial partitions, known as diaphragms, extending from the rotor post to the outer peripheral shell of the rotor. These sector shaped compartments are loaded with modular heat exchange baskets which contain the mass of heat absorbent material commonly comprised of stacked plate-like elements.

The rotor is surrounded by a housing and the ends of the rotor are partially covered by sector plates located between the gas inlet and outlet ducts which divide the housing into hot gas and cold gas sides. In order to improve the efficiency of operation, it is conventional to provide seals, which are referred to as radial seals, on the ends of the rotor such that the seals will come into proximity with the sector plates and minimize the flow of gases between the hot and cold sides at the ends of the rotor. These seals are attached to the top and bottom edges of the diaphragms.

The conventional modular heat exchange basket comprises a frame which is open on each end and which may or may not have solid side walls. These baskets are loaded axially into the rotor from the ends and stay plates are located between and support radially adjacent baskets. To ensure that the baskets can be freely inserted, it is necessary to have the baskets undersized as compared to the compartments formed by the diaphragms and stay plates so that there is a clearance. Therefore, gaps exist between the sides of the baskets and the diaphragms which permit a portion of the gas streams to bypass the heat exchange surface in the baskets. The present method of sealing the bypass gap is to weld bars of a proper width to the diaphragm so that they contact the basket and fill the gap. This method, in addition to being time consuming and expensive, still allows some leakage to occur due to irregularities in the basket alignment and the fact that the diaphragm may not be exactly flat.

SUMMARY OF THE INVENTION

The present invention relates to novel means for providing bypass seals around the baskets of a rotary regenerative air preheater to prevent the bypass of gas streams through the gaps between the baskets and the diaphragms. More specifically, a bent, flexible bypass seal is inserted alongside the baskets extending in a radial direction in the gap between one side of the baskets and the adjacent diaphragms. The bent, flexible seal is bolted or otherwise fastened to the diaphragm closing off the gap to gas flow between the basket frame and the diaphragm.

DESCRIPTION OF THE PREFERRED EMBODIMENT

Figure 1:
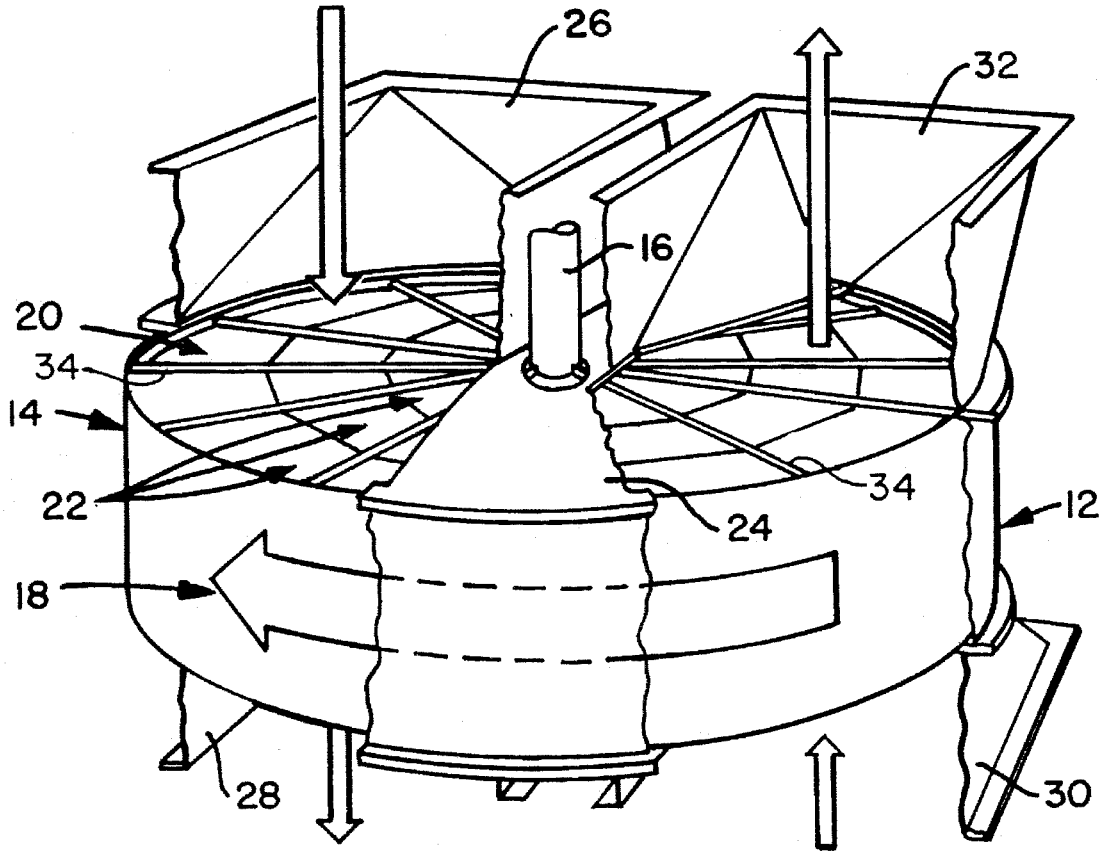
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32.

Figure 2:
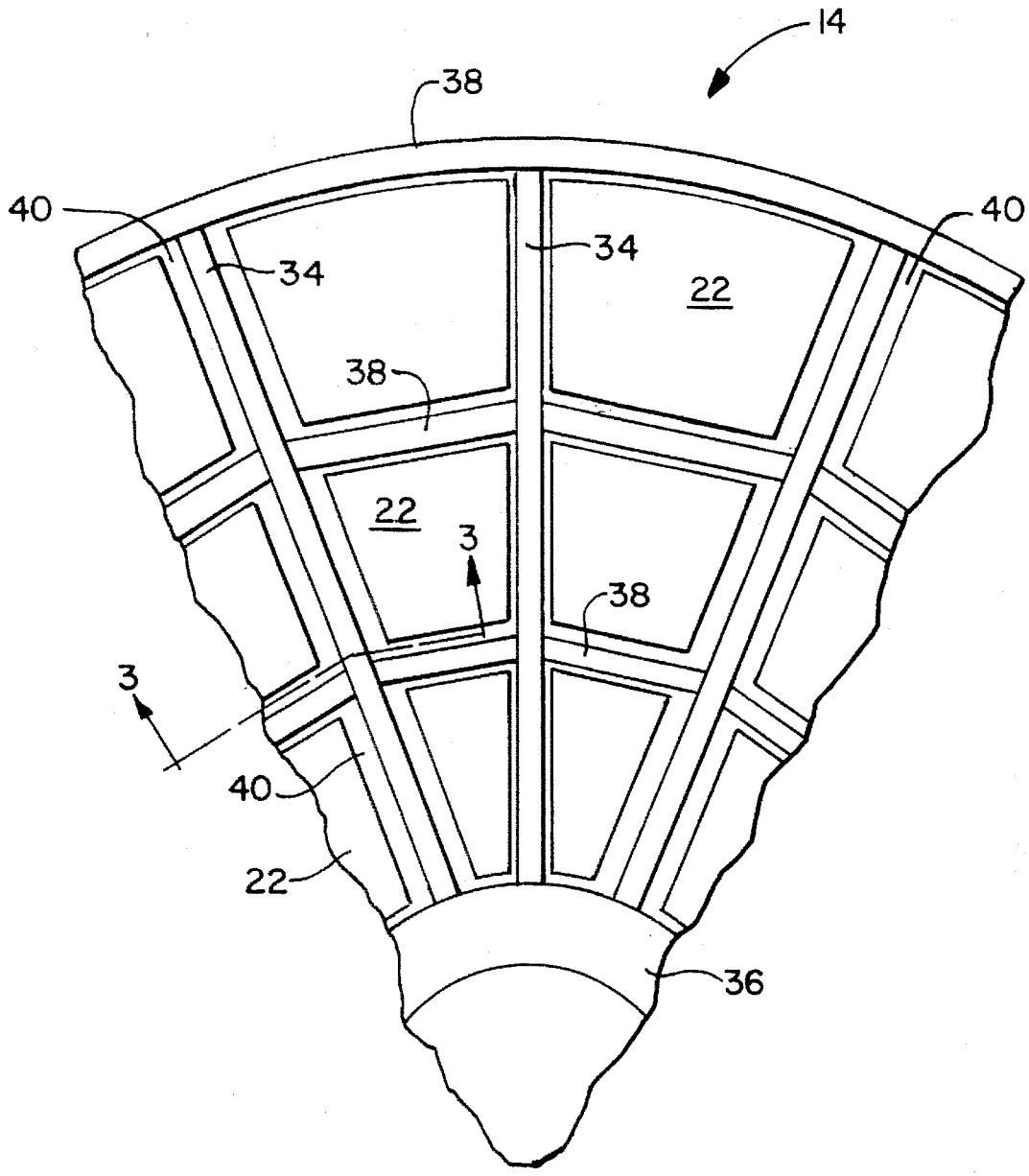
FIG. 2 is a top plan view of a portion of the rotor of the preheater of FIG. 1 illustrating one level of baskets in position between diaphragms.

Referring now to FIG. 2 which shows a plan view of a portion of a rotor 14, the diaphragms 34 are shown extending radially between the central portion 36 of the rotor and the rotor shell 38. Extending between the diaphragms 34 are the stay plates 38 which are welded to the diaphragms. These stay plates divided each sector into a plurality of radially adjacent basket compartments 40. The basket modules 22 are loaded into the rotor axially down into each compartment and sitting on top of each other. This FIG. 2 is a view with the basket modules installed but it does not specifically identify or illustrate the bypass seals of the present invention for purpose of clarity.

Figure 3:
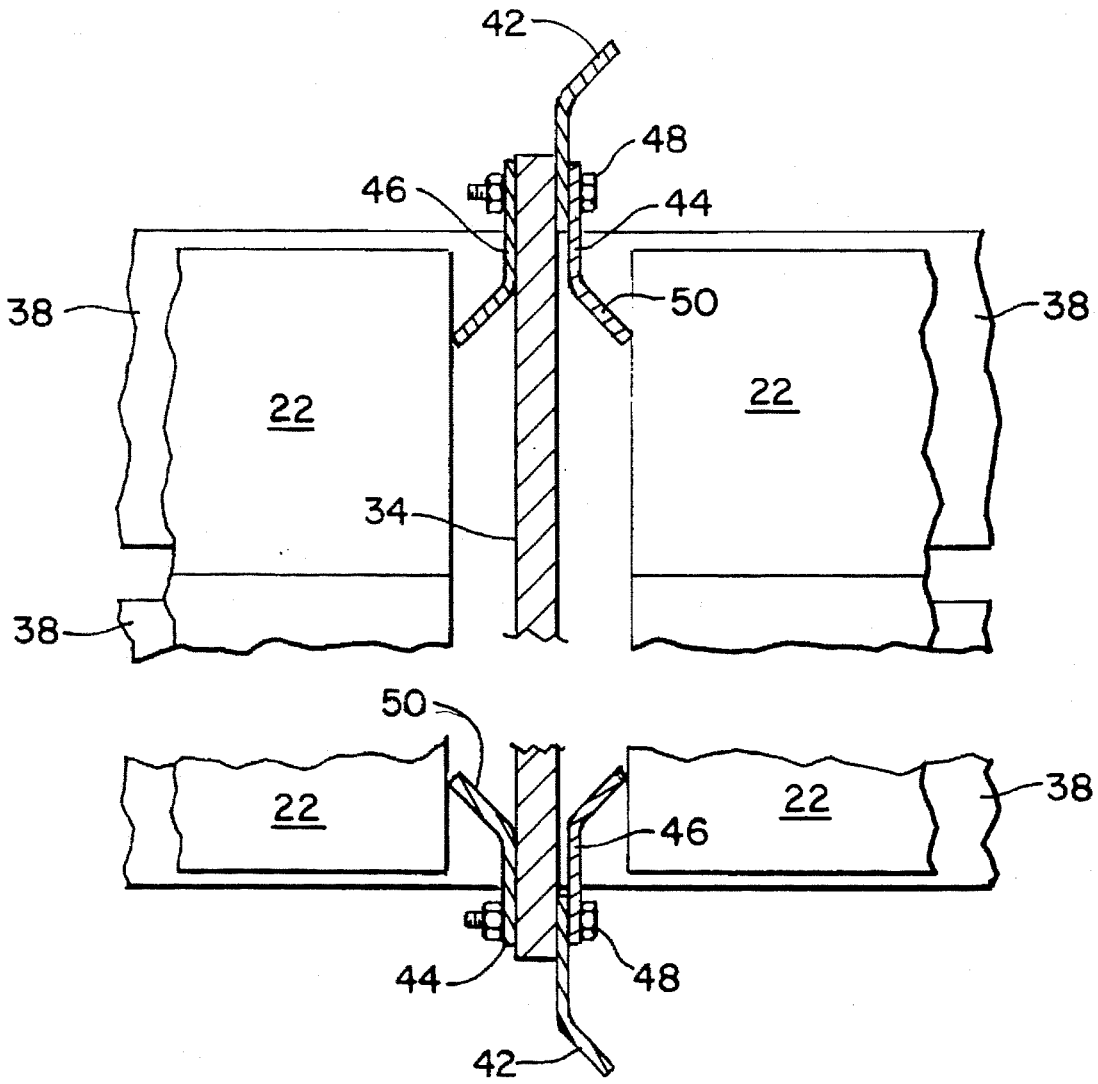
FIG. 3 is a cross section view of a portion of the rotor taken generally along line 3—3 of FIG. 2 and showing the bypass seals of the present invention.

FIG. 3 is a cross-section view taken generally along the line 3—3 of FIG. 2 and illustrates the radial seals 42 and the bypass seals 44 of the present invention. The radial seals 42 extend along the length of the top and bottom edges of each diaphragm 34. As previously indicated, these radial seals contact or come into close proximity with the sector plates 24 and prevent gas flow between the flue gas side and the air side of the air preheater in a known manner. A portion of the length of these radial seals 42 are shown in FIG. 4.

Figure 4:
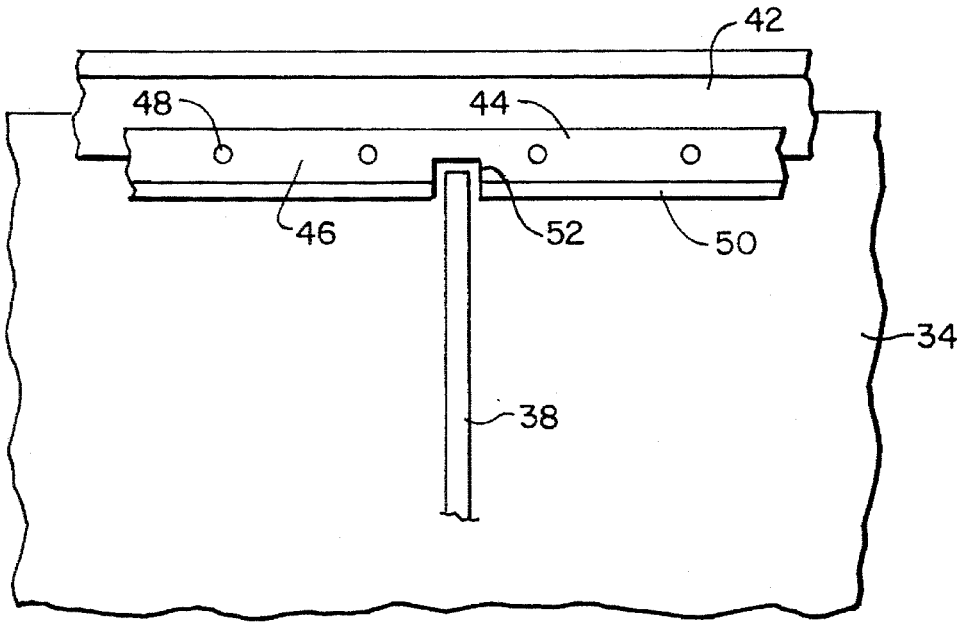
FIG. 4 is a side view of a portion of a diaphragm with a radial seal and a bypass seal installed.
Figure 5:
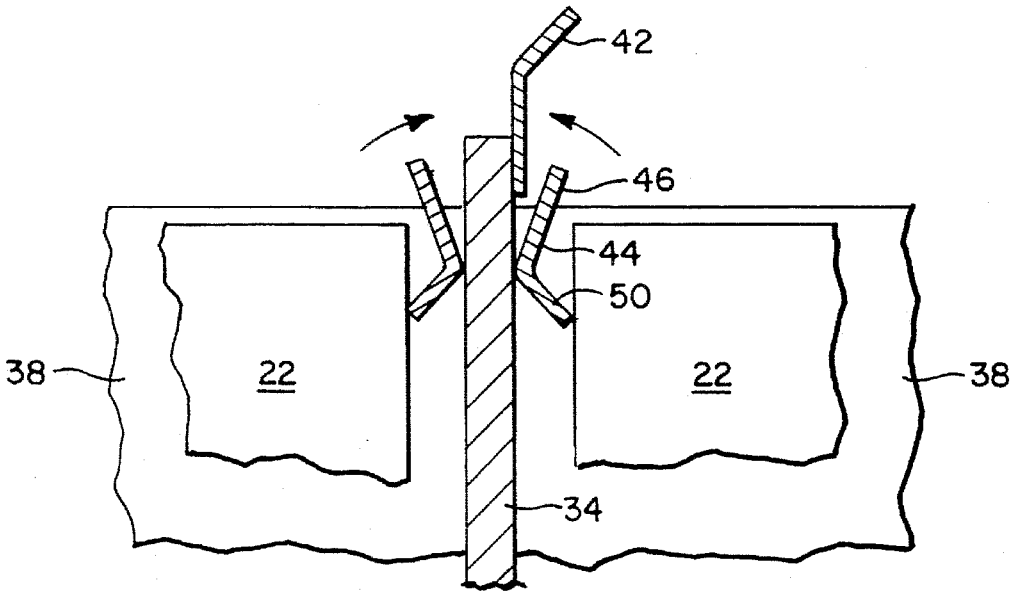
FIG. 5 is a view similar to a portion of FIG. 3 illustrating the installation of the bypass seals.

FIGS. 3 and 4 also illustrate the bypass seals 44 of the present invention. These seals also run in a radial direction along the top and bottom edges of the diaphragms 34. As can be seen, the bypass seals are similar in configuration to the radial seal 42 and basically comprise a bent, thin elongated strip. The main body portion of the seal, identified as 46, is fastened to the diaphragm 34 by the bolts 48. The size and angle of the bent portion or leg 50 of the bypass seal is selected on the basis of the width of the bypass gap and is made somewhat oversize to ensure that the leg 50 makes contact with the basket. The efficiency of the seal may be improved if the leg 50 of the bypass seal is constructed so that the edge of the leg in contact with the baskets is deformable and yet impervious to flow. The bypass seal is installed at an angle as illustrated in FIG. 5 which facilitates insertion to the proper depth along side the basket. The main body portion 46 of the seals is then pressed against the radial seal on one side and against the diaphragm on the other side and bolted in place. This also assures that the bent leg 50 makes a positive, tight seal against the basket. The bypass seal being bolted over the radial seal functions as a radial seal holding bar which was a separately required item in old designs. The bypass seal is notched at 52, as illustrated in FIG. 4, to fit over the stay plates 38 as required.

With the present invention, a positive seal is formed in the gaps between the sides of the baskets and the adjacent diaphragms. The welding of bypass bars is eliminated and the radial seal holding bar may no longer be needed. The bypass seal of the present invention is less costly to manufacture and install and it will tolerate some axial and radial movement of the baskets due to thermal growth or mechanical forces.

We claim:

1. A rotor assembly for a vertical shaft regenerative heat exchanger, said rotor assembly having a center portion, a top and a bottom and being mounted for rotation on an axially extending rotor shaft, said rotor assembly comprising:

a. a cylindrical outer rotor shell;

b. a plurality of diaphragm plates each extending radially in said rotor assembly from said center portion to said outer rotor shell and extending from said top to said bottom of said rotor assembly thereby dividing said rotor assembly into a plurality of sector-shaped compartments, each diaphragm plate having a top edge adjacent said top of said rotor assembly and a bottom edge adjacent said bottom of said rotor assembly;

c. a plurality of layers of truncated sector-shaped heat exchange baskets located in each sector-shaped compartment, each layer containing a plurality of said baskets radially adjacent to each other and extending from said center portion to said outer rotor shell and being of a size to form a gap between one side of said baskets and said diaphragms; and d. a radially extending bypass seal extending along and attached to each of said bottom and top edges of each of said diaphragms and positioned in said gap between said diaphragms and baskets, each of said bypass seals comprising a metal strip having a main portion abutting and attached to said diaphragm and a leg portion bent outwardly from said main portion and engaging said baskets to thereby fill said gaps between said diaphragms and said baskets along said top and bottom edges.

* * * * *